United States Patent [19]

Wyberg

[11] Patent Number: 4,712,727

[45] Date of Patent: Dec. 15, 1987

[54] GABLE-TOP CONTAINER CLOSURE SYSTEM

[75] Inventor: Gregory R. Wyberg, Minneapolis, Minn.

[73] Assignee: Minnesota Mining and Manufacturing Company, St. Paul, Minn.

[21] Appl. No.: 36,969

[22] Filed: Apr. 10, 1987

[51] Int. Cl.[4] ..... B65D 5/06

[52] U.S. Cl. ..... 206/631.3; 229/137

[58] Field of Search ..... 229/17 R, 17 G, 7 R, 229/138, 137; 206/631, 632

[56] References Cited

U.S. PATENT DOCUMENTS

| | | | |
|---|---|---|---|
| 2,750,095 | 6/1956 | Alden | 229/17 G |
| 3,081,927 | 3/1963 | Hayhurst | 229/17 G |
| 3,120,089 | 2/1964 | Monroe et al. | 53/186 |
| 3,178,089 | 4/1965 | Tobias et al. | 229/17 G |
| 3,239,995 | 3/1966 | Monroe et al. | 53/375 |
| 3,245,603 | 4/1966 | Wilcox | 229/17 G |
| 3,270,940 | 9/1966 | Egleston et al. | 229/17 G |
| 3,309,841 | 3/1967 | Egleston et al. | 53/373 |
| 3,334,799 | 8/1967 | Crawford | 229/17 G |
| 3,452,919 | 4/1968 | Avolio | 229/17 G |
| 3,554,430 | 1/1971 | MacEwen | 229/17 G |
| 3,827,625 | 8/1974 | Miller | 206/631 |
| 4,313,553 | 2/1982 | Lisiecki | 229/17 G |
| 4,390,121 | 6/1983 | Lisiecki | 229/17 G |
| 4,488,647 | 12/1984 | Davis | 206/631 |
| 4,527,732 | 7/1985 | Smith | 229/17 G |
| 4,576,285 | 3/1986 | Goglio | 206/632 |

*Primary Examiner*—Stephen Marcus
*Assistant Examiner*—Gary E. Elkins
*Attorney, Agent, or Firm*—Donald M. Sell; James A. Smith; Leland D. Schultz

[57] ABSTRACT

A gable-top thermoplastic coated container with controllably enhanced sealing and opening characteristics includes at least one fillet attached to the gable rib panels and/or roof rib panels which form the spout. The fillet comprises a thin strip of stiff material coated with a layer of adhesive. The strip is resistant to the thermal carton-sealing process, and extends along a portion of the panel length to increase the applied opening force which may be transmitted to the tip of the spout where the gable rib panels are adjoined and prevent buckling of the spout panels. The unadhered surface of the strip does not strongly adhere to the opposing thermoplastic coated panel, so that the spout may be opened with a controlled low force, without tearing or delamination of the carton panels. The portion of the fillet-carrying panel not covered by the fillet will bond to the opposing panel by thermoplastic fusion. Preferably, the adhesion layer is of such a thickness that a portion thereof is extruded during the carton sealing process, forming a bead of adhesive along the edges of the strip to bond the gable rib panels to the roof rib panels. The result is a hermetic seal which is readily opened without destruction of the spout panels.

22 Claims, 12 Drawing Figures

GABLE-TOP CONTAINER CLOSURE SYSTEM

BACKGROUND OF THE INVENTION

1. Field of the Invention

This invention relates to packaging, and particularly to an improved package construction using a pressure sensitive adhesive tape material to improve the opening characteristics of a disposable gable-top container suitable for the packaging of liquids. More particularly, this invention relates to a blank from which the container is formed.

2. Description of the Prior Art

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are pressed together and heated or exposed to high frequency radiation to fuse the adjoining thermoplastic surfaces and form a generally strong seal. To finally seal the filled container, two or more panels are finally joined and sealed to form a rib along the top edge of the roof panels. Exemplary of such container blanks are those shown in Alden U.S. Pat. No. 2,750,095 and Wilcox U.S. Pat. No. 3,245,603.

Containers of this type are opened for access to the contents of a two-step toggle action process. First, the gable edges of the roof panels at the front of the container are pushed outward and upward toward the rear of the container by thumb pressure, breaking the seal between the outside surfaces of the two lip panels, and breaking the seal in the rib panels surmounting the roof above the pouring spout. The gable edges are forced backward past the point at which the lip panels are joined, to nearly touch the roof panels.

Second, the gable edges are pushed forward and inward. The forces are communicated through spout panels to the tip of the pouring spout, breaking the seal between the lip panels and the underside of the roof panels and snapping the spout outward to a pouring position.

In early models of gable-top containers, the panels comprising the lips of the pouring spout were bonded to the underside of the roof panels. The resulting sealed spout was difficult to open, generally requiring insertion of a tool behind the lips to separate them from the roof underside. The cardstock panels often tore or delaminated, producing an unsightly and unsanitary container. In those cases where an adhesive was applied to only those panels which were to be joined, it was simple to eliminate adhesive from the spout panels to reduce the forces required to open the spout. The resulting container, of course, was not effectively sealed and was subject to leakage.

An improvement in gable-top containers to provide a hermetic seal for an extended shelf life package consisted of coating the inner surface of the container blank with a foil and an overcovering layer of thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking by liquids. However, the strong bonding of the lip panels results in buckling, tearing and delamination of the cardstock upon opening the seal. Thus, the spout is difficult to open, and the opened panels are unappealing in appearance.

Polyethylene has a low modulus of elasticity, so that the stiffness added by the coating is minimal.

As used in the food packaging industry, the term hermetic refers to a container designed and intended to be secure against the entry of oxygen which degrades flavor. The term is also used to designate containers used for aseptic filling and storage, i.e. containers secure against the entry of microorganisms. The hermetic barrier of such cartons typically comprises an aluminum or other barrier film coating the inner surface, overcovered with a thermoplastic such as polyethylene. The carton wall thickness is thus increased, resulting in larger channels where the edges of overlying panels have a stepped relationship in the gable rib area, increasing the chance for leakage.

Attempts to provide an easily opened spout seal have included (a) perforations in the spout panels which tear open to expose pouring lips, (b) improved control of the sealing temperature, (c) the use of added scoreline patterns to concentrate the opening forces, and (d) the use of anti-adhesion agents, i.e. adhesives, to reduce the required opening forces.

The use of perforations in the spout panels has generally been unsatisfactory. Such perforation produce a spout of reduced size, which requires special sealing operations. The perforations are considered by some to be a weak point in the carton, prone to develop leaks. This type of carton spout requires external forces such as thumbnail pressure to open, and this procedure is considered unsanitary. The carton cannot be effectively closed, once opened, and shaking of the carton results in spillage.

Likewise, efforts to reduce temperature variations in the sealing process have not produced a satisfactory hermetic sealing gable-top container. Because of narrow acceptable temperature range for obtaining the desired adhesion, sealing variations persist in spite of improved temperature control. Moreover, the required opening forces generally exceed the panel strength, even where minimal sealing is achieved.

The use of novel scoreline patterns generally has not overcome the strong sealing forces of well-sealed spouts and buckling of the spout panels is common.

One method for preventing the difficulty in opening the completely bonded lip panels of polyethylene coated gable-top containers is shown in Crawford et al, U.S. Pat. No. 3,116,002. In this reference, a thin coating of a high molecular weight organo-siloxane gum is applied to the lip panels as an adhesive, that is, to prevent permanent adhesion to the panels in contact with the lip panels.

Egleston et al, U.S. Pat. No. 3,270,940 discloses the use of an anti-adhesive composition applied to both the outside and inside surfaces of the pouring lip of a gable-top container. Abhesive agents disclosed include cellulose plastic laminated to polyethylene, the latter heat-bondable to the polyethylene surface of the cardstock blank.

The release properties of abhesives are generally affected by the heat sealing parameters and are inconsistent. Containers designed for hermetic use and having adhesives in the spout sealing area often require opening forces greater than the wall strength of the panels, and the spout panels buckle during the opening process.

SUMMARY OF THE INVENTION

The present invention is directed to an improvement in the formation of a package of paneled flexible material to stiffen the package material adjacent the sealed area to be opened. The result is a more reliable, consistently openable hermetically sealed opening for gaining access to the contents. The flexible material may be cardstock plastic, or other material with a thermoplastic inner surface coating which is sealed by elevated temperature and pressure. The flexible material may include a gas-impermeable film or foil layer. A blank of the package material with scoreline-defined panels is folded into the package shape and overlying panels are sealed. A typical sealing process consists of heating with hot air to a temperature which melts or fuses the thermoplastic surface coatings, and compressing together the panels to be joined.

Four body panels include a front body panel, a back body panel and first and second side panels. Bottom closure panel means is provided for closing the bottom of the gable-top container. Connected to the upper edges of the first and second side panels are the first and second roof panels, respectively. When assembled, the roof panels are oppositely disposed to converge upwardly, and are connected at their top edges to form a gable roof. The front edges of the roof panels have score lines defining subpanels which comprise first and second roof wing panels. The wing panels form the rear portion of the pouring spout.

First and second opposed, substantially triangular end panels are connected to the upper edges of the front and back body panels to extend upwardly therefrom.

A first foldback panel is connected to the first roof wing panel and to one lateral edge of the first triangular end panel. A second foldback panel is connected to the second roof wing panel and to the other lateral edge of the first triangular end panel.

A third foldback panel is connected to the other end of the first roof panel and to one lateral edge of the second triangular end panel. A fourth foldback panel is connected to the other lateral edge of the second triangular end panel, and is adapted to be connected to the second roof panel, opposite the second foldback panel.

First and second gable rib panels are connected to the upper edges of the first and second foldback panels, respectively, and extend upwardly therefrom. These gable rib panels are also connected to each other at a common line, and comprise lips of the pouring spout from which the container contents are discharged.

Third and fourth gable rib panels are connected to the upper edges of the third and fourth foldback panels, respectively, and extend upwardly therefrom.

First and second roof rib panels are connected to the upper edges of the first and second roof panels, respectively, and extend upwardly therefrom. Each roof rib panel is connected at one side thereof to one of the first and second gable rib panels.

First and second upper rib panels are connected to the upper edges of the first and second roof rib panels, respectively, and extend upwardly therefrom.

At least one stiffening or reinforcement fillet overlays a portion of, and is bonded to, the inner surface of at least one of the following panels:

(x) first gable rib panel,
(xx) second gable rib panel,
(xxx) first roof rib panel, and
(xxxx) second roof rib panel.

The fillet comprises (a) a strip of material resistant to deleterious effects of the conventional carton sealing process, i.e. it will not melt, flow or otherwise degrade at the temperature and pressure of the sealing process, and (b) a layer of adhesive attached to one side of the strip. The layer of adhesive adheres to the inner surface of at least one of the gable rib panel(s) and/or roof rib panel(s), strongly bonding one side of the strip to the panel or panels. The layer of adhesive is preferably adapted to be partially extruded from the fillet during the carton sealing process, forming a bead of extruded adhesive along the edge of the strip. This adhesive bead effectively bonds the gable rib panels to the inner surfaces of the roof rib panels, and together with the exposed portions of the rib panels which become thermally bonded, provides a hermetic seal. This bead, however, may be disrupted without tearing, buckling or delamination of the panels.

The fillet extends along a major portion of the force transmission line between the site where the opening force is applied and the intersection of the gable rib panels which receives the opening force. The fillet strengthens the panel member to which it is bonded, so that the resistance of the panel member to bending or buckling increases, and greater opening forces are transmitted to the spout tip. Simultaneously, the fillet controls the force required to break the hermetic seal between panel members, so that the required opening force is less than the force which will buckle or delaminate the panels. The sealing force is controlled by: (a) controlling the area and specific locations of the gable rib panels and roof rib panels which will be subject to thermoplastic heat-sealing, (b) controlling the adhesion between the resistant strip and both panels, and (c) controlling the thickness of the adhesive layer of the fillet for optional extrusion from the fillet, to adhesively join the gable rib panels to the roof rib panels in the pouring spout. In opening the gable-top container from the sealed condition, the force required is limited to a value below that which will tear, delaminate, or crumple the gable rib panels and/or the roof rib panels.

DETAILED DESCRIPTION

Figure 1:
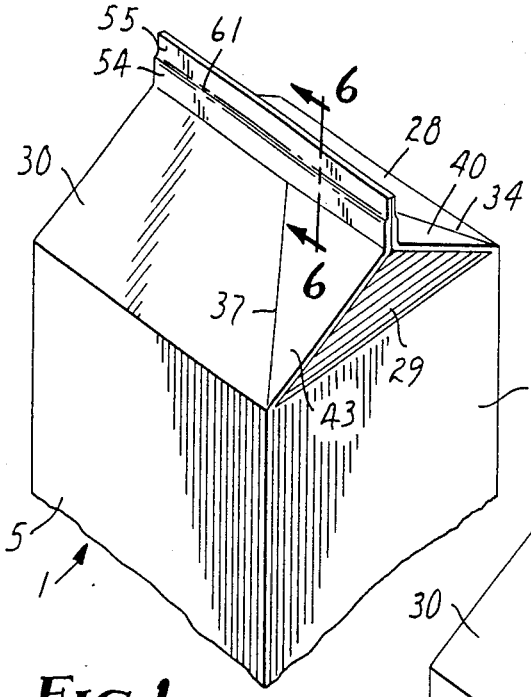
FIG. 1 is a perspective view of the upper end of a closed container formed from a blank according to one embodiment of the present invention.

Referring now to the drawings, the invention is depicted with reference to a gable-top container in which the invention is incorporated. A gable-top container is formed from a blank of paperboard or other suitable material coated on the inner planar surface, or on both the inner and outer surfaces with a thermoplastic material. The container blank is adapted to be erected and have certain panels sealed to each other by a container sealing process. Typically, the sealing process consists of compressing together the panels to be joined while those panels are at an elevated temperature. Other alternative sealing processes may also be utilized.

FIG. 1 shows a typical container 1 in a closed, sealed condition as for storage of beverages and the like. The container is self-sustaining in shape and is hermetically sealed.

Container 1 is comprised of a series of panels, including four body panels 2–5. Front body panel 4 and second side body panel 5 are shown in FIG. 1, while rear body panel 2 and first side body panel 3, not shown, oppose panels 4 and 5, respectively, forming a container of rectangular cross-section. Usually, the cross-section is square. The bottom of the container 1 is closed. First roof panel 28 is connected to the upper edge of first side panel 3. Second roof panel 30 is connected to the upper edge of second side panel 5. When the container is in the closed condition, the roof panels 28 and 30 converge upwardly to form a gable roof construction. Roof rib panel 54 is attached to roof panel 30 and extends upwardly therefrom. Likewise, upper rib panel 55 is attached to roof rib panel 54 and extends upwardly therefrom.

First triangular end panel 29 is connected to the upper edge of the front body panel 4. When the container is closed, end panel 29 is folded under the gable roof formed by the two roof panels. Also shown are first roof wing panel 40 and second roof wing panel 43. The roof wing panels 40 and 43 are subpanels of roof panels 28 and 30, respectively. A second triangular end panel, not shown in this figure, is usually adapted to remain folded under the opposite gable roof, unless it is desired to open both gable ends of the container.

Figure 2:
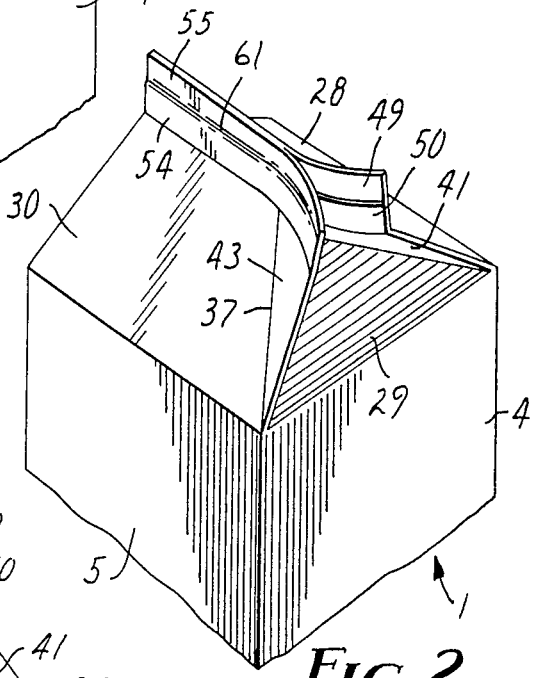
FIG. 2 is a perspective view of the container end of FIG. 1 with a partially opened rib.

FIG. 2 shows the container of FIG. 1 in which the spout has been partially opened. The first and second foldback panels 41 and 42 and overlapping roof wing panels 40 and 43 are typically pushed outward and backward with thumb pressure to break the seal between the inner surfaces of the first and second upper rib panels 49 and 55, and between the outer surfaces of the first and second gable rib panels 50 and 52, the latter not visible in this drawing. The gable rib panels are connected to the upper edge of foldback panels 41 and 42, and extend upwardly therefrom.

Figure 3:
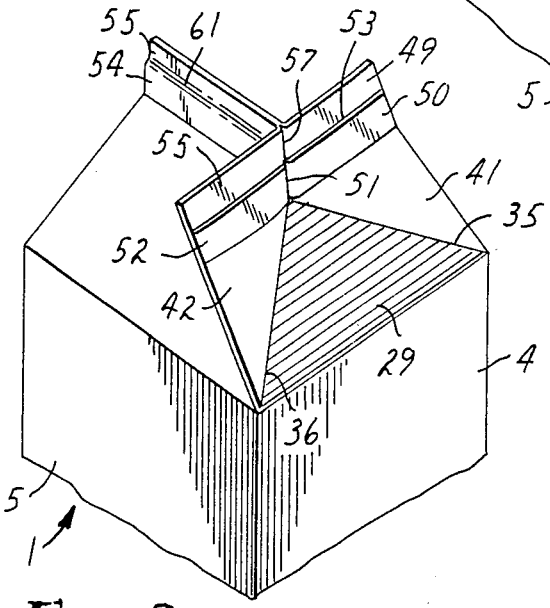
FIG. 3 is a perspective view of the container end of FIG. 1 with its sealed rib fully open and the spout panels in the closed position.
Figure 5:
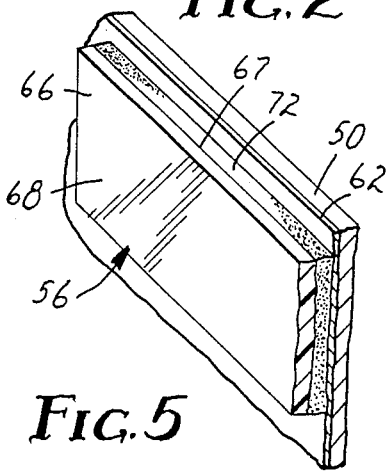
FIG. 5 is a perspective view of a portion of a reinforcement fillet attached to a container panel according to the present invention. The cross-section of the fillet and panel are expanded to show the laminar construction.

FIG. 3 shows the container at the point where foldback panels 41 and 42 have been pushed backward about 90 degrees from their sealed position. These panels are roughly triangular in shape, each having one edge defined by scoreline 35 or 36, where they are attached to a lateral edge of first triangular end panel 29. First and second gable rib panels 50 and 52 act as lips of the pouring spout, and meet at a common gable rib score line 51. The upper terminus 51A of the common rib score line at the free edge 53 of the pouring lip comprises the tip of the pouring spout. First and second upper rib panels 49 and 55 extend upwardly from the first and second roof rib panels 48 and 54 to a level higher than the free upper edge 53 of gale rib panels 50 and 52.

To complete the unsealing and opening of container 1, foldback panels 41 and 42 are pushed backward beyond the position shown in FIG. 3. The roof rib panels and upper rib panels will fold along foldline 57. The blank may or may not be scored at that location.

The gable rib panels are slightly longer than the roof rib panels. Thus, after the panels are folded backward, a subsequent forward and inward movement of wing panels 40 and 43 transmits opening forces in a toggle-like action along the wing panels and gable rib panels 50 and 52 toward the common line 51 between the gable rib panels. A component of these forces extends outward and upward from line 51 and from gable score lines 35 and 36 to pull the gable rib panels 50 and 52 away from roof rib panels 54 and 48, the latter not visible in FIG. 3, and to pull foldback panels 41 and 42 away from roof wing panels 40 and 43. Likewise, triangular end panel 29 is forced outward, and the distended panels create a pouring spout. The various score lines delineating the panels act as hinges for the panels as they are unfolded.

The force required to distend the spout in this fashion may be calculated theoretically. If the gable rib panels are looked upon as a beam which is to be buckled in the center, the force P required for bucking to occur may be described as:

$$P = CEI/(L^2)$$

where:

$C = (pi^2) = 9.87$ for hinged ends.
$E$ = modulus of elasticity of beam.
$I$ = moment of inertia of the beam.
$I = bh^3/12$ where
$b$ = width and
$h$ = thickness of the beam. and
$L$ = length of the beam.

Analysis of the opening forces is complex. In general however, the gable rib panels, foldback panels, and roof rib panels must be relatively stiff to prevent the panels from crumpling, and to transmit the applied opening forces to common line 51. The sealing forces which bond the gable rib panels to the roof rib panels are preferably only as high as required to maintain the hermetic seal. Excessive bonding forces will require greater stiffness in the spout panels to prevent crumpling of the panels during the opening process.

Certain features of this invention will produce a liquid-proof spout seal which is easily opened without tearing, delamination, or buckling of the spout panel members. These features underlie the spout panel members in FIG. 3, and are not visible in that figure. These features include one or more fillets 56, shown in FIG. 4 and described in reference to the remainder of the figures.

Figure 4:
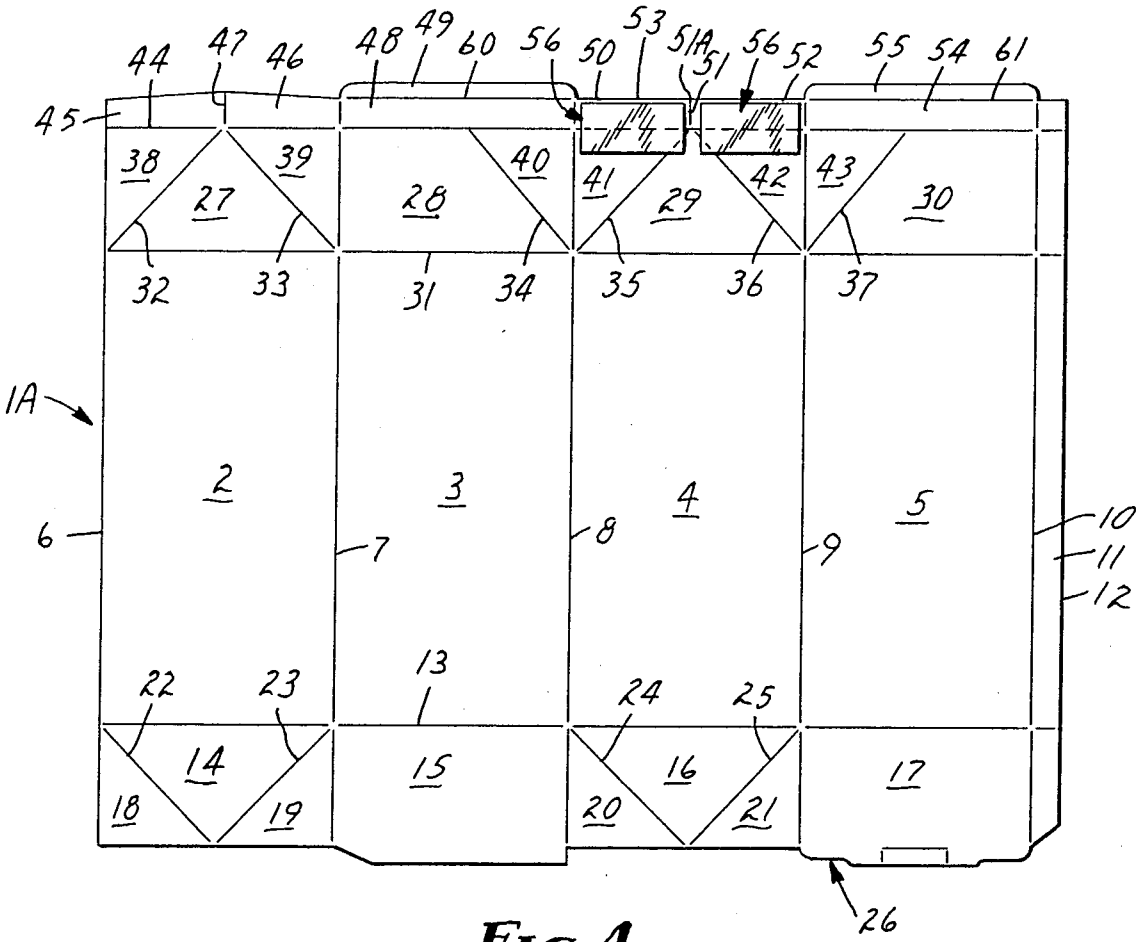
FIG. 4 is a plan view of an embodiment of the container blank according to the invention.

FIG. 4 illustrates an exemplary flat sheet material blank of this invention for constructing a gable-top container. The inner surface or face is shown, and it is coated with a thermoplastic such as polyethylene. The outer surface may also be similarly coated. The sheet material may include a gas impermeable layer such as aluminum foil. An appropriate pattern of score lines divides blank 1A into a plurality of panels and subpanels which are used as walls of the container and its closure parts when the container is erected.

The central portion of blank 1A comprises four body panels 2, 3, 4, and 5, having their lower edges along bottom score line 13, and their upper edges along top score line 31. These transverse score lines are shown as extending from blank edge 6 to opposite blank edge 12 in substantially parallel relationship across the face of the blank. Vertical score lines 7, 8 and 9 transect the blank to define the lateral edges of the body panel 2, 3, 4 and 5, and other panels above the body panels. These and other score lines are not necessarily straight, but may be slightly offset in certain sectors of the blank to improve the fit of the various panels in the erected container.

In the example shown in FIG. 4, side seam flap 11 is connected to one lateral edge 10 of a body member for sealing to the edge of another body member 2 by the container sealing process. Bottom closure means 26 is shown as a group of bottom closure panels 14 through 21 attached to the body members along bottom score line 13, and extending downward therefrom. Bottom closure score lines 22 through 25 enable bottom closure panels 14, 16, and 18–21 to be folded under closure panels 15 and 17 and sealed to provide a leakproof container bottom. Such a closure means is well-known in the art. A separately formed structure may alternatively be used to close the bottom of the container. In fact, any closure means which results in a satisfactorily tight seal may be used.

The gable top of the container is formed from a series of panels above top score line 31. First and second roof panels 28 and 30 are connected to the upper edges of the first and second side panels 3 and 5, respectively. The roof panels are oppositely disposed and when erected, converge upwardly to meet along score line 44 to form a gable roof. Connected to the upper edge of the front panel 4 is a first substantially triangular end panel 29 whose two lateral edges 35 and 36 formed by score lines extend upwardly to score line 44. Similarly, second triangular end panel 27 is connected to the upper edge of back panel 2, and has lateral edges 32 and 33 which extend upwardly to score line 44.

On each side of triangular end panel 29 is a foldback panel. First foldback panel 41 is connected to triangular end panel 29 along edge 35, and to first roof wing panel 40 along score line 8. Panel 41 has a score line 44 as its upper edge. Similarly, second foldback panel 42 is connected to triangular end panel 29 along edge 36, and to second roof wing panel 42 along score line 9. It has score line 44 as its upper edge.

Similarly, third and fourth foldback panels 39 and 38 are connected to triangular end panel 27 along lateral edges 33 and 32, respectively. The third foldback panel 39 is attached to the first roof panel 28 along score line 7, and the fourth foldback panel 38 is connected to the second roof panel 30 by side seam flap 11 when the container is erected.

Attached to the upper edge of each foldback panel 38, 39, 41 and 42 along score line 44 is a gable rib panel 45, 46, 50 and 52, respectively. Similarly, attached to the upper edge of first and second roof panels 28 and 30 are first and second roof rib panels 48 and 54, respectively. First and second gable rib panels 50 and 52 are connected to each other at a common score line 51, and third and fourth gable rib panels 46 and 45 are connected to each other at common score line 47. The uppermost end 51A of line 51 is the tip of the pouring spout of the erected container.

First gable rib panel 50 is connected to first roof rib panel 48 at score line 8, and second gable rib panel 52 is connected to second roof rib panel 54 at score line 9.

First roof wing panel 40 comprises a triangular portion of first roof panel 28 defined by score lines 34, 44 and 8, and is adjacent first foldback panel 41. Second roof wing panel 43 comprises a triangular portion of second roof panel 30 defined by score lines 37, 44 and 9 and is adjacent second foldback panel 42. These roof wing panels are more or less coextensive with the adjacent foldback panel when the erected container is closed.

A first upper rib panel 49 is connected to the upper edge of the first roof rib panel 48. Likewise, a second upper rib panel 55 is connected to the upper edge of the second roof rib panel 54. The score lines 60 and 61 separate the upper rib panels from the adjacent roof rib panels, and are substantially continuous with the free upper edge 53 of the first and second gable rib panels 50 and 52. The latter panels serve as lips of the pouring spout of the erected container.

The score lines may be applied to blank 1A before or after the thermoplastic coating is applied to the blank. The score lines may be applied to either surface or both surfaces of the blank. For purposes of clearer delineation of the various panels, score lines are shown in the drawing on either or both of the inner and outer surfaces of the blank and container.

In the embodiment shown in FIG. 4, two stiffening fillets 56 overlie portions of the first and second gable rib panels 50 and 52, and extend downwardly to overcover portion of the first and second foldback panels 41 and 42 and small upper portions of first end panel 29.

As illustrated in an enlarged perspective view in FIG. 4, each fillet 56 comprises a strip 66 of material resistant to the container sealing process, and a layer 72 of adhesive. This adhesive layer 72 is attached to (a) a first planar surface 67 of strip 66 and to (b) the inner thermoplastic surface 62 of one or more of (x) the first gable rib panel 50, (xx) the second gable rib panel 52, (xxx) the first roof rib panel 48, and (xxxx) the second roof rib panel 54. The strip 66 of material is thus sealed to the thermoplastic inner surface 62 of one or more of these panels.

Strip 66 may be formed from any solid material which is resistant to any deleterious effect of the container sealing process, and is sufficiently rigid so that, together with adhesive layer 72, it provides sufficient strength to reinforce the panel to achieve the necessary stiffness. Thus, the bond strength between the adhesive-free surface 68 of strip 66 to the thermoplastic coating must be significantly less than the bond strength between the strip 66 and the adhesive layer 72, or between the adhesive layer 72 and the strip 66. Furthermore, strip 66 must not melt, extrude, or otherwise degrade at the temperature and pressure conditions of the container sealing process. Of course, a container sealing process of significant compression of the panels at an elevated temperature may tend to increase the area of intimate contact and relieve elastic stresses, causing adhesive of strip 66 to the thermoplastic inner surface 62. The adhesive strength of this pressure-produced bond will be significantly less than the adhesive strength of the adhesive layer 72, however.

Material such as metallic foil, polyester film, and polycarbonate film are examples of strip materials which are unaffected by the temperatures used for sealing panels coated with polyethylene. Such thermoplastic coatings are typically sealed at temperatures of 250° to 400° F. (81° and 205° C.).

The strip 66 and adhesive layer 72 may be preformed as a tape which is applied by machine to the blank 1A.

For hermetic sealing containers, the modulus of elasticity of strip 66 may be as low as $0.2\times10^6$ psi ($1.4\times10^8$ kg/m$^2$), but preferably is at least $0.4\times10^6$ psi ($2.8\times10^8$ kg/m$^2$).

The stiffness of the fillet 57 must be such that the panel with the attached fillet has greater stiffness than a panel without the fillet. This relationship may be expressed as follows:

$$E_2 > E_1(h_1)^3/(h_2)^3$$

where:

$E_1$=modulus of elasticity of panel.

$E_2$=modulus of elasticity of panel+fillet.

$h_1$=thickness of panel.

$h_2$=thickness of panel+fillet.

It is preferred that $E_2$ be greater than $0.2\times10^6$ pounds per square inch ($1.406\times10^8$ kg per square meter) to provide the desired stiffness.

The layer 72 is of such an adhesive type and thickness that when the fillet 56 is compressed between gable rib panel 50 and 52 and roof rib panels 48 and 54 during the first sealing process, a portion of the adhesive of layer 72 extrudes from between the panel or panels and strip 66 of resistant material. The extruded adhesive fills channels otherwise open to leakage and effectively seals the container. The adhesive used may be sealable by pressure, heat, or other process.

Figure 6:
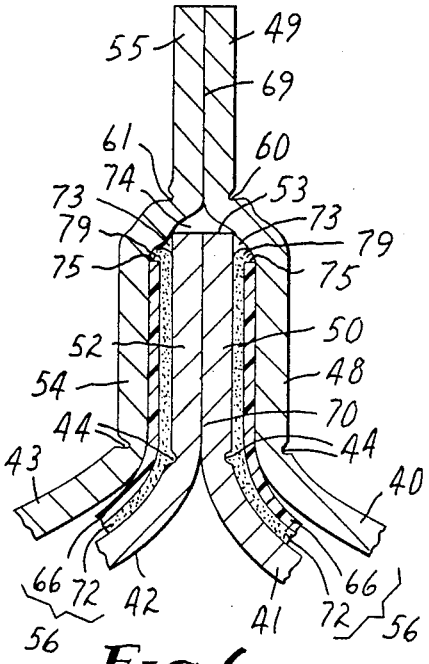
FIG. 6 is a cross-sectional view through the closed upper closure along line 6—6 of FIG. 1.

FIG. 6 is an enlarged cross-sectional view through the rib portion of a container formed from this invention, showing the panel members and fillet exaggerated in thickness for the sake of clarity. It is understood that all of the panel members shown include a thermoplastic coating on at least the inner surfaces, and preferably on both the inner and outer surfaces. Additionally, the panel members may include a film or foil of gas-impermeable material such as aluminum, overcovered by the thermoplastic coating.

First and second roof rib panels 48 and 54 overlie first and second gable rib panels 50 and 52. The gable rib panels are separated from foldback panels 41 and 42 by scorelines 44, and the roof rib panels are likewise separated from roof wing panels 40 and 43 by scorelines 44. Upper rib panels 49 and 55 are separated by score lines 60 and 61 from the roof rib panels 48 and 54, and extend upwardly therefrom. Each of the panels shown in the figure includes a coating of thermoplastic on at least the inner surface. Stiffening fillet 56 is shown attached to the inner face of gable rib panels 50 and 52, and to an upper portion of foldback panels 41 and 42. The fillet includes resistant strip 66 and adhesive layer 72.

Fillet 56 may comprises a tape having a relatively thick backing or strip 66 of a stiff material whose bond to the thermoplastic surface of the panels is weaker than its bond to adhesive layer 72. The adhesive layer 72 may be thermoplastic in nature, but preferably is a pressure-sensitive adhesive. The latter affords easier positioning during application to the blank 1A, and does not require the application of heat for positioning. However, the thermal carton sealing process has been found to significantly enhance the sealing strength of the pressure-sensitive adhesives (PSA's) which were tested. Typical pressure sensitive adhesives can be formed into stable thick layers at room temperature, and will readily extrude at the temperatures and pressures used to thermally seal polyethylene. Thus, when an extruded bead of adhesive is desired, PSA's appear to work well.

In FIG. 6, the container contents occupy the space between panel 40 and panel 41, and the space between panel 42 and panel 43.

When the first sealing process is thermal in nature, the upper rib panels, the gable rib panels, and the roof rib panels are heated to the softening or melting point of the thermoplastic coating, and compressed together as shown in FIG. 6. The upper rib panels are bonded on their inner surfaces at interface 69, and gable rib panels 50 and 52 are preferably mutually bonded on their outer surfaces at interface 70.

A further sealing feature may be produced if desired. A thick layer 72 of an extrudable adhesive may be used in the fillet. Compression at an elevated temperature during the carton sealing process extrudes the adhesive from between the gable rib panels and strip 66, and the extruded bead 79 of adhesive bonds overlying panels 50 and 52 just above the upper edge 75 of strip 66. A similar extrusion of adhesive is produced along the lateral edges of strip 66 as well, both where the gable rib panels and roof rib panels are joined, and along the exposed portion of the common gable rib score line. A hermetic seal is achieved where the adhesive extrudes, even when the bead of extruded adhesive is minimal. The quantity of extruded adhesive may be varied by controlling the type of adhesive, the thickness of the adhesive layer, and the temperature and pressure of the carton sealing process. The quantity of extruded adhesive may be controlled to fill the small channels 73 or channel 74 which typically develop along the free upper edge 53 of the gable rib panels.

Furthermore, the space at the tip of the pouring spout, that is, the space between common line 51 and the corresponding line 47 of the third and fourth gable rib panels, usually not securely sealed in the prior art by the first sealing process, may also be controllably filled with a bead of extruded adhesive during the carton sealing process to provide an aseptic or essentially hermetic seal. This seal is especially enhanced by features to be later described.

Because the bead bonding the gable rib panels to the roof rib panels is relatively narrow, the seal may be broken with minimal force to open the spout. The adhesion of strip 66 to the container panel should preferably produce a peel strength greater than 50 oz. per inch of width (612 grams per cm. width) at room temperature, so that the fillet will remain an integral part of the panel to which it is attached, both before and after the spout panels are unsealed and unfolded. The fillet may be adhesively attached to either the gable rib panels or the roof rib panels, depending upon which is desired for the particular application. Fillets adhered to the roof rib panels are somewhat less effective at transferring the opening forces than fillets adhered to the gable rib panels. However, the concomitant reduction in required opening force enables fillets on the roof rib panels to transfer the required forces.

In this invention, the thickness of adhesive layer 72 is considerably greater than would be required for merely bonding strip 66 to a panel. For example, while the latter may be attained with a monomolecular layer of adhesive, this invention generally requires an adhesive layer exceeding 0.001 inch (0.0025 cm) in thickness for achieving desired additional stiffness and leakproof hermetic sealing. An adhesive layer of about 0.002 inch (0.005 cm) has proven optimal for certain pressure sensitive adhesives used to seal polyethylene coated containers. With other adhesives, a thickness of up to 0.004 inch (0.0102 cm) may be used.

Figure 7:
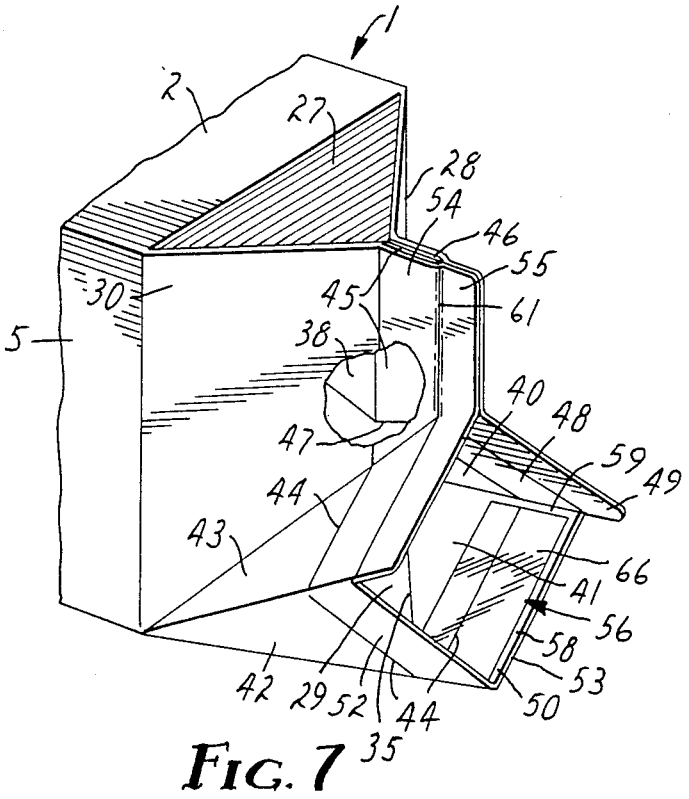
FIG. 7 is a perspective view of the upper portion of a gable-top container formed from one embodiment of a blank according to the present invention. A portion of the container is cut away to view panel members below the roof and roof rib panels.

FIG. 7 shows a gable-top container 1 formed from the blank of FIG. 4 and sealed according to the container sealing process, and subsequently opened from the closed and sealed condition. Second roof panel 30 and first roof panel 28 converge upwardly so that their upper edges 44 meet or almost meet. Roof rib panels 48 and 54 are sealed along approximately one-half of the length of the rib structure, and enclose third and fourth gable rib panels 45 and 46. When the container is closed, common scoreline 47 between the third and fourth gable rib panels is somewhat spaced from common scoreline 51. The void between those scorelines is a vertical channel which when filled with adhesive will prevent leakage. First and second upper rib panels 49 and 55 are joined by the container sealing process. The spout panels of the rib structure are shown to have been opened by first breaking the seal between the upper rib panels 49 and 55, and then breaking the seal between gable rib panels 50, 52 and roof rib panels 48, 54. First triangular end panel 29, and first and second foldback panels 41 and 42 are folded outward to extend the pouring spout.

Stiffening fillet 56 is shown at the inside of the pouring spout, overlying and attached to a portion of the inside surface of the first gable rib panel 50 and the second gable rib panel 52, not visible in this view. Conforming to a preferred embodiment, the fillet 56 also extends downward over scoreline 44 to overcover a portion of foldback panels 41 and 42. The advantages of such extension will be later described.

Fillet 56 is shown as spaced from roof wing panel 40 and roof rib panel 48 to form side spacing 59, and also spaced from the free upper edge 53 of gable rib panel 50 to form lip spacing 58. During the first sealing process, a portion of the adhesive is extruded from the adhesive layer of the fillet 56 into channels 73, previously described, resulting from spacings 58 and 59, to effectively seal these areas from leakage. The surface 68 of the fillet 56 which has no adhesive layer is, of course, in contact with roof rib panels 48 and 54 when the carton is sealed. Fillet 56, being resistant to the container sealing process, does not strongly adhere to the thermoplastic surfaced roof rib panels, although the pressures and temperatures typical of the first sealing process minimally result in a close conformity of their surfaces which is subsequently maintained by the tight seal of the rib panel members. The seal between surface 68 and the overlaying panel, though not as tenacious as that of the opposite adhesive coated side of the strip, nevertheless prevents fluid leakage. A hermetic seal results from (a) the thermoplastic heat seal between exposed portions of the gable rib panels and opposing roof rib panels, or (b) a bead of adhesive extruded from beneath the strip, to be described later, or (c) a combination of the two.

FIGS. 8 through 12 show a portion of the blank 1A, including those panels which become the pouring spout. These figures depict various embodiments of fillet 56 in terms of the particular panel area or areas covered thereby.

Figure 8:
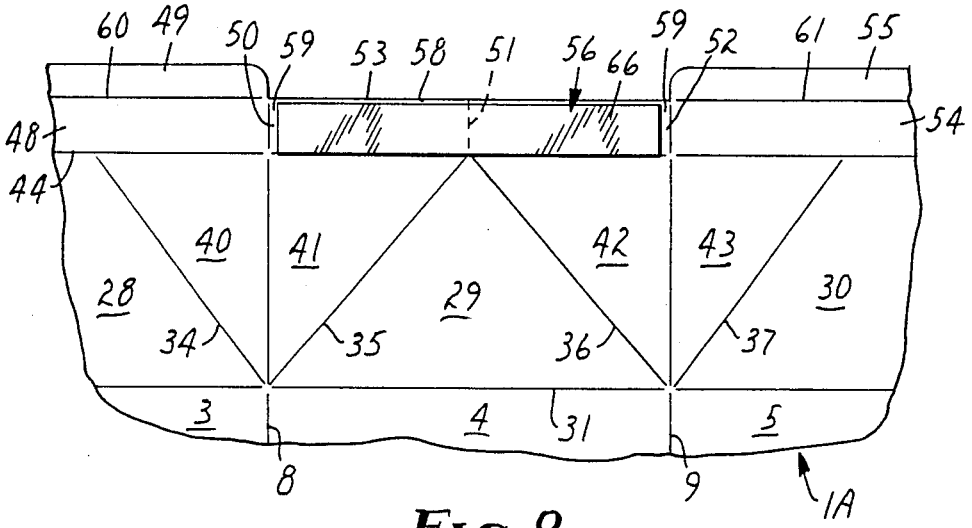
FIGS. 8 through 12 are plan views of the interior face of various embodiments of the present invention.

In FIG. 8, a single fillet 56 overcovers all or a portion of both gable rib panels 50 and 52. The uppermost edge of fillet 56 may be generally continuous with the upper free edge 53 of the gable rib panels, but is preferably spaced therefrom by less than 0.15 inches (0.38 cm) when a bead of extruded adhesive is to be a part of a hermetic seal of the container. When the uppermost edge of fillet 56 is lower than free edge 53 by more than 0.3 inches (0.76 cm), an excessive sealing area for the thermoplastic carton sealing process may result. This produces a strong seal which may require an excessive opening force to break the seal. Also extruded adhesive may not reach and fill the narrow channel which generally forms above the edge 53. The narrow spacing 58 provides space which in some cases is desirably filled with extruded adhesive, minimizing the thermoplastic-to-thermoplastic seal area and substituting an extruded adhesive seal. The relatively narrow band of adhesive provides a tight seal between the gable rib and roof rib panels which is nevertheless openable with an acceptable opening force.

When the fillet or fillets 56 are adhesively attached to both gable rib panels 50 and 52, and the uppermost edge of the fillets extend above the upper free edge 53 of the gable rib panels, the heat sealing process will bond the exposed portions of the strips 66 on each gable rib panel to each other. In addition, the amount of adhesive extruded into the sapce above the strips 66 may be decreased. Therefore, it is generally desirable to limit such upward extension of the fillet or fillets above the gable rib panels 50 and 52 to not more than 0.15 inches (0.38 cm).

Each end of the fillet 56 may be spaced from the roof rib panels 48 and 54 to form spaces 59. The spacing provides room for the panels to fold around the fillet at scorelines 8 and 9. Preferably, the spacing 59 between fillet 56 and the roof rib panels is not less than 0.01W, where W is the length of the first or second gable rib panel 50 or 52. The maximum spacing 59 is controlled by the length of fillet which will provide the desired stiffness to the panels, and may be as great as 0.6W, where W is as defined above.

Figure 9:
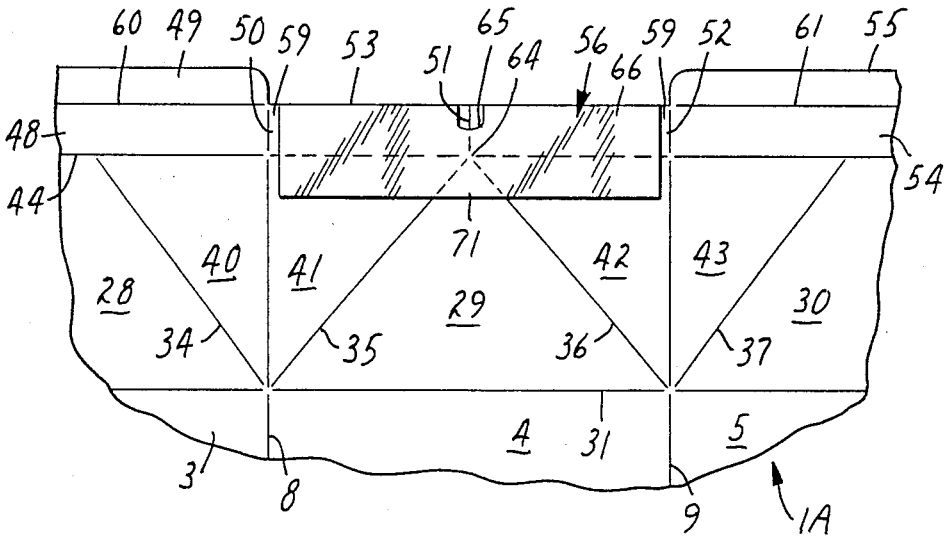
Figure 10:
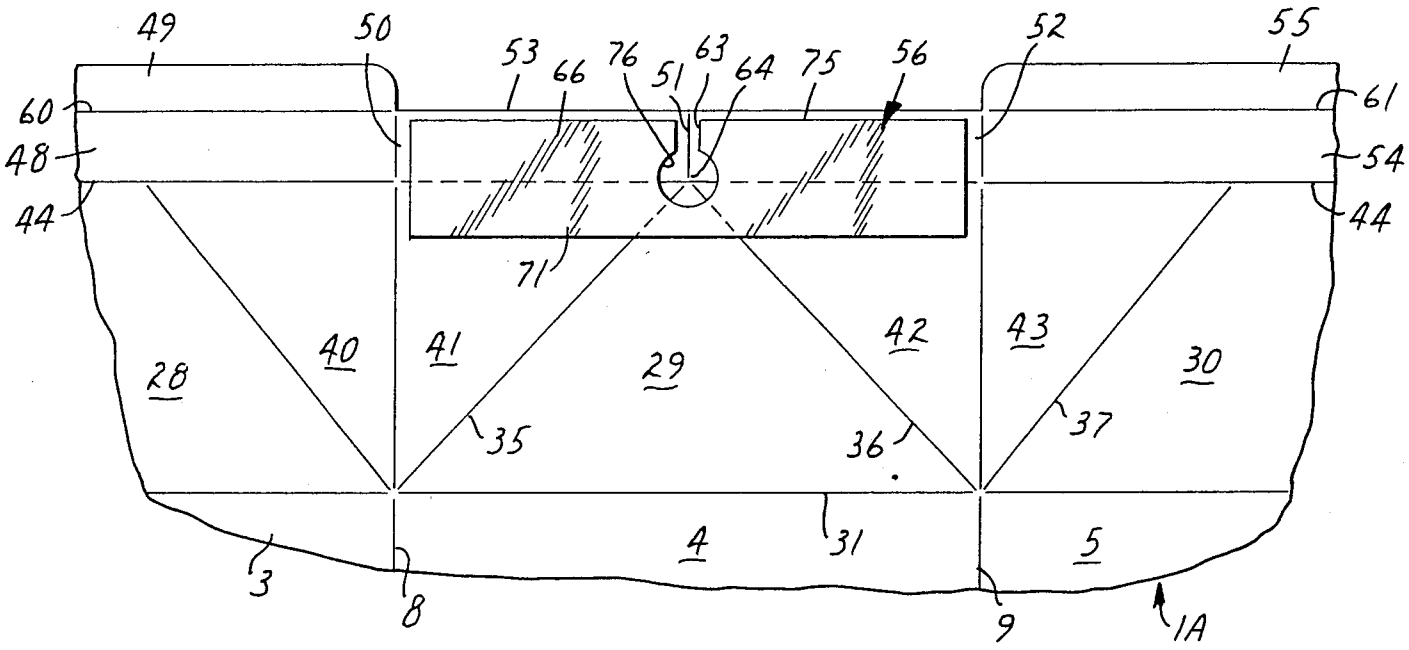

FIG. 9 illustrates a fillet 56 overcovering a portion of the gable rib panels 50 and 52, and extending downwardly to overlie in bonded relationship a portion of the first and second foldback panels 41 and 42. The fillet also optionally overlies the upper portion of first triangular end panel 29. The advantage of this downward extension 71 is evident when the container sealing process in one which affects the bonding strength of the fillet adhesive layer. In common heat sealing processes used to seal polyethylene coated blanks, heat is directly applied to the panels to be sealed, i.e., the rib panels. Panels below the rib panels are only incidently heated and attain a considerably lower temperature. The sealing temperature is difficult to accurately control, and if the fillet adhesive softens excessively, the fillet strip may slide downward, not retaining its proper alignment on the gable rib panel or panels. The portion of the fillet below the gable rib panels will be much less affected because of the lower temperature, and will maintain the original position of the fillet. The high adhesion of adhesive layer 72 is regained upon cooling.

The figure also shows the fillet as overlying score line apex 64 at the top of triangular end panel 29.

It has been discovered that enhanced sealing results from cutting, notching or slotting the strip 66 where it overcovers the common gable rib scoreline 51, especially the portion of the common line just below its upper terminus 51A. Thus, strip 66 may include a cut extending downwardly from the upper edge of the strip, along at least a portion of the common line 51. This enables adhesive from layer 72 and/or melted thermoplastic polyethylene to extrude through the cut, notch or slot to contact the opposite gable rib panels 45 and 46 at common scoreline 47, and bond thereto. This difficult-to-seal site is thus effectively sealed.

Fillet 56 is further shown in FIG. 9 with a notch 65 extending downwardly from the upper edge of the strip, along the common line 51 between the first gable rib panel 50 and the second gable rib panel 52. The notch may optionally extend downwardly to expose apex 64, as further shown in FIG. 10, or may extend downward as a slot through the fillet to divide it into two fillets. When a notch or slot exposes the common line 51, the edge of the fillet strip may be separated from a portion of the common line by up to 0.3 inches (0.76 cm). When there are two fillets, each overcovering a portion of one of the gable rib panels, the maximum spacing of each fillet from common line 51 is also 0.3 inches (0.76 cm). A greater spacing results in insufficient stiffening of the panels in the vicinity of common line 51, and in addition, the container sealing process will bond an excessive portion of exposed gable rib panel along line 51 to the corresponding roof rib panel with a thermoplastic-to-thermoplastic bond. Such a tight bond at the point where the opening forces first act to unseal the spout make such unsealing difficult. Greater force is required, and with less reinforcement, the end of the spout may crumple. When an aperture 76 exposes the apex 64, as in FIG. 10, the edge 63 of the fillet is preferably spaced from the apex by less than 0.3 inches (0.76 cm).

Optionally, the shape of fillet 56 may be such that scorelines 35 and 36 are not covered thereby. The forces required to open the seal are further reduced by so doing.

Figure 11:
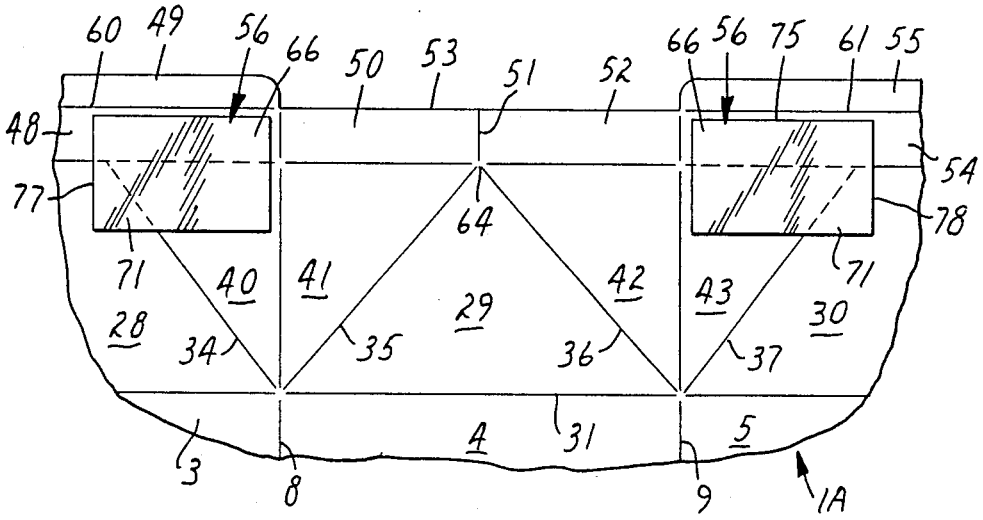

As shown in FIG. 11, a further embodiment comprises placement of fillets on one or both of the roof rib panels 48 and 54. The size and shape of the fillets are such that when the seal is closed, the fillets generally correspond in coverage to those applied to the gable rib panels. Thus, the upper edge 75 of each fillet 56 is no more than 0.3 inch (0.76 cm) from scoreline 60, 61, and preferably with 0.15 inch (0.38 cm). Likewise, it is preferred that fillet edges 77 and 78 are no more than about 0.3 inches (0.76 cm) from common line 51 when the container spout is sealed. This ensures sealing of the space between common foldlines 51 and 47.

Figure 12:
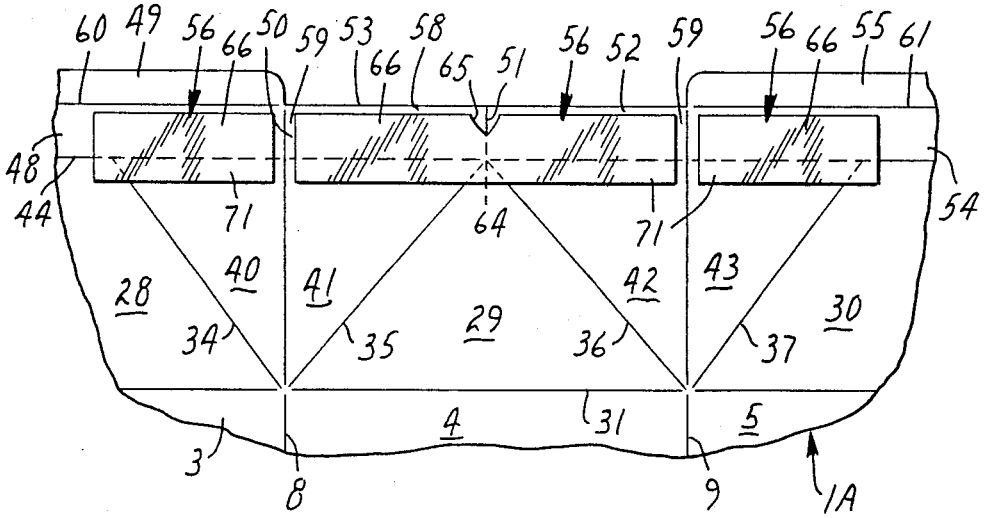

FIG. 12 illustrates an embodiment whereby fillets are attached to the inner surfaces of both the gable rib panels and roof rib panels. In this embodiment, it is imperative that the material from which the strips 66 are made will not soften or melt under the container sealing conditions to fuse the corresponding fillets together in a strong bond. A limited degree of sealing is acceptable, and may even be preferred. The previous discussion regarding the desired fillet sizes and coverage also applies.

When applied to a container blank which includes a hermetic barrier, the container seal of this invention may be adapted to provide a hermetically sealed container under various conditions of cardstock thickness and strength as well as container size.

EXAMPLE 1

Commercial hermetically sealed 0.5 gallon (1.9 liter) gable-top containers were manually opened. After folding back the wing panels, simple forward hand pressure on the roof rib panels resulted in buckling and distortion of the gable rib panels, without opening the tip of the spout at the common fold line. In all cases, insertion of a knife blade between the gable rib panels and roof rib panels near the common fold line was required to open the spout.

Container blanks of the same material were sealed by hand, using a Liquipak TM model 010 hand sealer. Attempts to open the containers produced the same results as were obtained with the commercially sealed containers. An applied force of 15 pounds-force (6.8 kg-force) resulted in tearing and buckling of the panels, without opening the spout.

The opening force required by a previously opened hermetically sealed carton was determined to be abut 2.6 pounds-force (1.2 kg-force).

For the sake of comparison, a common milk carton opened from the sealed condition with an applied force of about 3.0 pound-force (1.36 kg-force), without tearing of the spout panels. This carton is sealed only to the extent of preventing liquid leaks, and a hermetic barrier is not provided.

EXAMPLE 2

Several types of fillet were applied to polyethylene coated cardstock for determining the effect upon panel stiffness and ease of container opening.

The container material was manufactured by International Paper Company for hermetically sealed cartons, and comprised paperboard having an aluminum film bonded to the inside surface, and both sides then coated with thermoplastic polyethylene.

The types of adhesive used in the fillets included (a) ethylene-vinyl acetate (EVA) copolymer, (b) medium density polyethylene (MDPE), and (c) a pressure-sensitive adhesive (PSA).

The modulus of elasticity was determined by measuring the deflection caused by a weight placed on the center of a simple beam formed from the cardstock. Measurements were made on the cardstock itself, on a pair of gable rib panels from a blank, and from the entire outer spout assembly comprising the gable rib panels, triangular end panel, and foldback panels. The formula used to calculate the modulus was:

$$E = fL^3/4ba^3Y$$

where

E = modulus of elasticity.
f = force applied, 0.11 pound (50 g) for most tests.
a = thickness of beam.
b = width of beam, 1.0 inch (2.54 cm).
Y = deflection, inches (cm).
L = length of beam = 3.7 inches (9.4 cm).

The results were as follows:

| Beam Material | a Thickness | Y Deflection | E, Modulus, PSI(kg/cm$^2$) |
|---|---|---|---|
| Cardstock (unreinforced) | 0.027 in. (0.069 cm) | 0.18 in. (0.46 cm) | 393,000 ($2.76 \times 10^8$) |

-continued

| Beam Material | a Thickness | Y Deflection | E, Modulus, PSI(kg/cm$^2$) |
|---|---|---|---|
| Cardstock with transverse scoreline. | 0.027 in. (0.069 cm) | 0.33 in. (0.84 cm) | 28,000 (0.2 × $10^8$) |
| (f = 10 g because of reduced modulus) | | | |
| Cardstock with fillet of 0.004 in. (0.010 cm) polyester and 0.002 in. (0.005 cm) EVA adhesive (Scotchpak TM 26 tape) | 0.036 in. (0.091 cm) | 0.090 in. (0.23 cm) | 332,000 (2.33 × $10^8$) |
| Cardstock with fillet of 0.002 in. (0.005 cm) polyester and 0.003 in. (0.0075 cm) PSA | 0.032 in. (0.079 cm) | 0.12 in. (0.30 cm) | 390,000 (2.7 × $10^8$) |
| Spout panels, not preflexed | 0.027 in. (0.069 cm) | 0.080 in. (0.20 cm) | 885,000 (6.2 × $10^8$) |
| Spout panels, preflexed | 0.027 in. (0.069 cm) | 0.21 in. (0.53 cm) | 337,000 (2.4 × $10^8$) |
| Polyester Film (Literature Value) | | | 400,000 (2.8 × $10^8$) |

The results indicate that the modulus of elasticity is approximately the same, i.e., $0.4\times10^6$ psi ($2.8\times10^8$ kg/m$^2$) for preflexed panels, either with or without the added fillet.

Buckling forces were calculated from the data of Table 2 using $$P_{crit}=CEh^3b/12L^2,$$

where $P_{crit}$ is the forward-directed force at which buckling will occur, lb-force;

C is pi$^2$,

E is the modulus of elasticity, approximately $0.4\times10^6$ psi;

h is thickness, 0.027 inches (0.069 cm);

b is width, 1.0 inch (2.54 cm); and

L is length, 3.7 inches (9.40).

The calculated force required to open (buckle the spout tip) the unsealed spout of unreinforced cardstock was 0.5 pounds (0.23 kg.).

The force carried by both of the unreinforced gable rib panels prior to buckling was calculated to be 1.9 pounds (0.86 kg.), using L=1.85 inches. This leaves 1.9−0.5=1.4 pounds (0.64 kg.) of force for breaking the bond at the tip of the spout.

Reinforcement of the gable rib panels with a 0.002 inch (0.005 cm) thick polyester strip and 0.002 inch (0.005 cm) layer of PSA adhesive provided a higher calculated available force of 2.9−0.5=2.4 pounds for breaking the bond at the spout tip. In this case, the net panel thickness was 0.031 inches (0.079 cm.).

Reinforcing the gable rib panels with 0.004 inch (0.010 cm) thick polyester and a 0.002 inch (0.005 cm) layer 62 of EVA adhesive provided a calculated available force of 4.6−0.5=4.1 pounds (2.09 kg.) for breaking the bond at the spout tip. In this case, the net panel thickness was 0.036 inches (0.142 cm). Thus, as a thicker, stiffer reinforcement strip is added, the applied forward-directed opening force available for opening the spout tip greatly increases.

Measurements were made of the force required to open a previously opened gable top hermetic sealing carton, using a spring gauge. The average measured force of 2.4 pounds (1.09 kg.) included the force required to buckle the extreme tip of the unreinforced spout, that is, the common fold line of the gable rib panels. Thus, the calculated value of the force transmitted by the unreinforced spout panels is only 1.9 pounds (0.86 kg.), nearly equal to the measured force of 2.4 pounds (1.09 kg) required to open the previously opened carton. This demonstrates that the greater joint strength of a sealed spout will result in buckling of the cardstock when opening forces are applied to the spout panels. On the other hand, when the gable rib panels were reinforced with a fillet according to this invention, the added stiffness provided an available opening force greater than 2.4 pounds to the common fold line, and the containers were opened without buckling or delamination of the panels.

The effects of several variables upon ease of opening were subjectively evaluated. Ease of opening was enhanced by (a) an increase in gable rib area covered by the fillet, (b) fillets of greater stiffness, (c) cutting, notching or slotting the fillet strip 66 along the common fold line between the gable rib panels, (d) leaving uncovered the score line apex where the end panel touches the common fold line, and (e) a reduction of gable rib area which is permitted to thermally seal to the roof ribs.

EXAMPLE 3

Several types of adhesive tapes were evaluated for use as fillets for ease of positioning in the spout, adhesion to the gable rib panels, and opening characteristics. The last are a function both of the additional stiffness gained by the panels and the bonding forces between the roof rib (or gable rib) panels and (a) the fillet strip, (b) the exposed portion of the opposed gable rib (or roof rib) panels, and (c) the extruded adhesive, if present.

The fillet configuration of FIG. 9 was utilized. The notch 65 extended downwardly one half of the height of the gable ribs, and the fillet extended 1.0 inch (2.5 cm) below the score line 44 separating the gable rib panels and foldback panels 41 and 42.

The tapes included:

Scotchpak TM 26: 0.004 inch (0.01 cm) polyester backing as the strip, with 0.002 inch (0.005 cm) EVA adhesive.

Scotchpak TM 48: 0.0005 inch (0.0012 cm) polyester backing with 0.004 inch (0.01 cm) MDPE adhesive.

Scotchtab TM : 0.002 inch (0.005 cm) polyester backing as the strip, with 0.002 inch 90.005 cm) PSA adhesive.

Scotchpak TM 26 with 0.003 inch (0.0075 cm) PSA adhesive applied over the EVA adhesive.

Polyester/PSA: 0.002 inch (0.005 cm) polyester film backing as the strip, with 0.003 inch (0.0076 cm) PSA adhesive.

Control: No fillet.

The pressure-sensitive adhesive (PSA) used in this test was a typical rubber-resin adhesive.

The results of the tests were as follows:

Scotchpak TM 26 with EVA adhesive was difficult to position for sealing, and required preliminary heat sealing to provide a good seal. The sealed carton spout opened easily without buckling or delamination.

Scotchpak TM 48 with MDPE adhesive was difficult to position and required preliminary heat sealing. Insufficient stiffness was added to the fillet to consistently transfer the required opening forces to the spout tip. Scotchtab TM with PSA adhesive was easy to position, and required heat sealing to strongly bond to the panels. The sealed carbon spout opened easily without buckling or delamination.

Scotchpak TM 26 with PSA adhesive was easy to position, and heat-sealing provided a good seal. The sealed spout opened easily without buckling or delamination.

The control gable top carton spout, heat-sealed according to the commercial process, could not be opened without buckling and delamination of the cardstock.

EXAMPLE 4

There are no standard tests for evaluating the seal integrity of "hermetically sealed" containers. However, a dye penetration test was performed on "hermetically sealed" cartons both with and without a fillet attached to the gable rib panels. Several configurations of the fillet were tested. The dye comprised 1.2 grams of Rhodamine B in 600 grams of isopropyl alcohol. The dye solution was introduced into an inverted carton having its gable-top sealed, and held for 10 minutes. The solution was then poured out and the carton rinsed with water. The spout was opened and the degree of dye penetration into the seal area was noted. Containers formed from blanks without the fillets of this invention and sealed conventionally to form "hermetic seals" would not be opened without directly applying force to the inside of the spout. Tearing and delamination resulted. All of the containers formed from blanks of this invention were easily opened without significant tearing or delamination of the spout panels. Little dye penetration was noted in any of the opened container spouts, but the penetration was greater in containers without the fillet or fillets.

While the present invention has been particularly set forth in terms of specific embodiments thereof, it will be understood in view of the instant disclosure that numerous variations upon the invention are enabled to those skilled in the art, which variations yet reside within the scope of the present teaching. Accordingly, this invention is to be broadly construed, and limited only by the scope and spirit of the claims now appended hereto.

What is claimed is:

1. A sheet material blank for constructing a sealed gable-top container with a thermoplastic inner surface coating responsive to a container sealing process, said blank comprising:

(a) four body panels including front and back panels and first and second side panels;

(b) bottom closure panel means for closing a bottom of a said container;

(c) first and second oppositely disposed roof panels connected to upper edges of said first and second side panels, respectively;

(d) first and second opposed substantially triangular end panels connected to upper edges of said front and back body panels, (e) first and second foldback panels, said first foldback panel connected to said first roof panel and to one lateral edge of said first triangular end panel, and said second foldback panel connected to said second roof panel and to the other lateral edge of said first triangular end panel;

(f) third and fourth foldback panels, said third foldback panel connected to said first roof panel and to one lateral edge of said second triangular end panel, and said fourth foldback panel connected to the other lateral edge of said second triangular end panel and adapted to be connected to said second roof panel;

(g) first and second gable rib panels connected to upper edges of said first and second foldback panels and having upper edges and lateral edges, and connected to each other at a common line;

(h) third and fourth gable rib panels connected to upper edges of said third and fourth foldback panels, respectively, and to each other;

(i) first and second roof rib panels connected to upper edges of said first and second roof panels, respectively, each said roof rib panel connected at one side thereof to one of said first and second gable rib panels;

(j) first and second upper rib panels connected to upper edges of said first and second roof rib panels, respectively;

(k) first roof wing panel comprising a triangular portion of said first roof panel adjoining said first foldback panel and said first roof rib panel and connected thereto;

(l) second roof wing panel comprising a triangular portion of said second roof panel adjoining said second foldback panel and said second roof rib panel and connected thereto; and (m) at least one stiffening fillet overlying a portion of, and bonded to the inner surface of at least one of said (x) first gable rib panel, (xx) second gable rib panel, (xxx) first roof rib panel, and (xxxx) second roof rib panel, for simultaneously stiffening said overlain panel to transfer applied opening forces therealong and for limiting the force required to open said container from the sealed condition, said fillet comprising a strip of material resistant to the temperature and pressure of said container sealing process and a layer of adhesive attached to one side of said strip and to said inner surface of said at least one said panel for bonding said strip thereto.

2. The blank according to claim 1 wherein said layer of adhesive is of a material which can be partially extruded from said fillet during said container sealing process to form a bead of extruded adhesive along said upper and lateral edges of said at least one said panel, to seal said at least one of said gable rib and roof rib panels to the corresponding one of said roof rib and gable rib panels.

3. The blank according to claim 1 wherein said resistant material comprises one of metallic foil, polyester film and polycarbonate film.

4. The blank according to claim 1 wherein the combined thickness of said strip and said adhesive is 0.001 to 0.01 inches (0.025 to 0.25 mm).

5. The blank according to claim 1 wherein the thickness of said adhesive layer is 0.001–0.004 inches (0.025 to 0.11 mm).

6. The blank according to claim 1 wherein said strip is spaced from said foldline separating said roof rib panels from said gable rib panels by a distance of (0.01–0.6)W, where W is the length of said one of said first and second gable rib panels.

7. The blank according to claim 1 wherein said fillet comprises a tape having a pre-applied layer of pressure-sensitive adhesive on one side thereof.

8. The blank according to claim 7 wherein the adhesion peel strength of said tape to said thermoplastic surfaced sheet material equals or exceeds 50 ounces force per inch (612 gram-force per cm.) of tape width.

9. The blank according to claim 1 wherein said fillet overcovers a portion of said first and second gable rib panels.

10. The blank according to claim 9 wherein the uppermost edge of said strip of resistant material is spaced from the upper edge of said gable rib panels by less than 0.15 inch (3.8 mm).

11. The blank according to claim 9 wherein the uppermost edge of said strip of resistant material is generally continuous with the upper edge of said gable rib panels.

12. The blank according to claim 9 wherein said fillet overlies a portion of said first and second gable rib panels and extends downwardly to overlie a portion of said first and second foldback panels, and is bonded thereto.

13. The blank according to claim 9 wherein said strip includes a cut extending downwardly from the upper edge of said strip along at least a portion of said common line between said first and second gable rib panels.

14. The blank according to claim 9 wherein said strip includes a notch extending downwardly from the upper edge of said strip, along said common line between said first and second gable rib panels.

15. The blank according to claim 9 wherein said strip includes a slot along said common line between said first and second gable rib panels separates said strip from at least a portion of said common line by up to 0.3 inches (0.76 cm).

16. The blank according to claim 9 wherein said fillet has an aperture therethrough exposing the apex of said first triangular end panel and said thermoplastic surface surrounding said apex.

17. The blank according to claim 12 wherein said fillet comprises two strips of said resistant material, each said strip overlying and bonded to a portion of one of said first and second gable rib panels.

18. The blank according to claim 17 wherein one edge of each said strip is spaced from said common line connecting said first and second gable rib panels by up to 0.3 inches (7.6 cm).

19. The blank according to claim 1 wherein said strip has a modulus of elasticity of at least $0.4\times10^6$ psi.

20. A hermetically sealed gable-top container for extended shelf life having a thermoplastic inner surface coating, said container comprising:

(a) four body section panels including front and back panels and first and second side panels;

(b) bottom closure panel means for closing a bottom of said container;

(c) first and second oppositely disposed roof panels connected to upper edges of said first and second side panels, respectively;

(d) first and second opposed substantially triangular end panels connected to upper edges of said front and back body section panels, respectively, and extending upwardly therefrom;

(e) first and second foldback panels, said first foldback panel connected to said first roof panel and to one lateral edge of said first triangular end panel, and said second foldback panel connected to said second roof panel and to the other lateral edge of said first triangular end panel;

(f) third and fourth foldback panels, said third foldback panel connected to said first roof panel and to one lateral edge of said second triangular end panel, and said fourth foldback panel connected to the other lateral edge of said second triangular end panel and connected to said second roof panel;

(g) first and second gable rib panels connected to upper edges of said first and second foldback panels, respectively, and extending upwardly therefrom, and to each other at a common line;

(h) third and fourth gable rib panels connected to upper edges of said third and fourth foldback panels, respectively, and to each other;

(i) first and second roof rib panels connected to upper edges of said first and second roof panels, respectively, each said roof rib panel connected at one side thereof to one of said first and second gable rib panels;

(j) first and second upper rib panels connected to upper edges of said first and second roof rib panels, respectively;

(k) first roof wing panel comprising a triangular portion of said first roof panel adjoining said first foldback panel and said first roof rib panel and connected thereto;

(l) second roof wing panel comprising a triangular portion of said second roof panel adjoining said second foldback panel and said second roof rib panel, and connected thereto; and (m) at least one stiffening fillet disposed between and adhesively bonded on one of said gable rib panels and opposed said roof rib panels, for stiffening said at least one panel to transfer applied opening forces therealong and for controlling the force required to open said container, said fillet comprising a strip of material resistant to the heat and pressure applied to seal said container and a layer of adhesive disposed between said strip of material and said one of said gable rib panels and said opposed roof rib panels.

21. The blank according to claim 20, wherein said strip has a modulus of elasticity of at least $0.4\times10^6$ psi.

22. The container according to claim 20 wherein said adhesively bonded fillet is bonded by a layer of pressure sensitive adhesive to one of said gable rib panels and said roof rib panels, and said adhesive is at least partially extruded from between said strip and said one panel to form a bead along said upper edge of said one panel to further seal said one panel to said opposed one of said roof rib and gable rib panels.

* * * * *

UNITED STATES PATENT AND TRADEMARK OFFICE

CERTIFICATE OF CORRECTION

PATENT NO. : 4,712,727

DATED : December 15, 1987

INVENTOR(S) : GREGORY R. WYBERG

It is certified that error appears in the above-identified patent and that said Letters Patent is hereby corrected as shown below:

Col. 7, line 54, "42" should read --43--.

Col. 9, line 15, "57" should read --56--.

Col. 12, line 53, "in" should read --is--.

Signed and Sealed this

Thirteenth Day of June, 1989

*Attest:*

*Attesting Officer*

DONALD J. QUIGG

*Commissioner of Patents and Trademarks*